US006524151B1

(12) United States Patent
Clemente et al.

(10) Patent No.: US 6,524,151 B1
(45) Date of Patent: Feb. 25, 2003

(54) SHAFT SEAL SYSTEM

(76) Inventors: Decio Carlos Clemente, Rocha Azevedo 1388, 01410-002 Sao Paulo (BR); Jean Pierre Gaston Rochebois, Rua Alucuz Da, Azurado #482, Conua Putuibuda, RJ (BR); Jaques Rochebois, 18123 SW. 20 St., Miramar, FL (US) 33029

( * ) Notice: Subject to any disclaimer, the term of this patent is extended or adjusted under 35 U.S.C. 154(b) by 0 days.

(21) Appl. No.: 09/922,560

(22) Filed: Aug. 3, 2001

(51) Int. Cl.[7] ..... B63H 23/36
(52) U.S. Cl. ..... 440/112
(58) Field of Search ..... 440/49, 83, 112; 277/346, 551, 572, 585

(56) References Cited

U.S. PATENT DOCUMENTS

| | | | | | |
|---|---|---|---|---|---|
| 3,563,555 | A | * | 2/1971 | Koons | 277/309 |
| 3,599,990 | A | * | 8/1971 | Greiner et al. | 277/370 |
| 5,911,607 | A | * | 6/1999 | Lacko et al. | 277/572 |
| 6,039,320 | A | | 3/2000 | MacDonald | 277/370 |

FOREIGN PATENT DOCUMENTS

| | | | | |
|---|---|---|---|---|
| DE | 03034561 | * | 3/1982 | 440/112 |
| DE | 3220595 | * | 12/1983 | 440/112 |
| SU | 01754580 A1 | * | 8/1992 | 440/112 |

* cited by examiner

*Primary Examiner*—Stephen Avila
(74) *Attorney, Agent, or Firm*—A. Bordas; J. Sanchelima

(57) ABSTRACT

A shaft seal system for watercrafts, where a seal from the system may be replaced while the watercraft is in water. The invention comprises two seals, one at each end of a cylindrical member having cooling and lubrication means. Water enters an entry port and circulates throughout camera channels within the cylindrical member and around a shaft which drives the watercraft propeller. The water then exits an exit port. The cylindrical member has a removable ring at one end, which keeps the first seal pressed in place. When the first seal deteriorates and needs to be replaced, the exit port water line is disconnected to determine if the second seal is in satisfactory condition. If the second seal is preventing water from entering the camera area, said ring is removed. A replacement seal already upon the shaft is slid in place, and said ring is re-secured. If the second seal is not in good condition but only a small amount of water enters, the replacement of the first seal may still take place.

9 Claims, 3 Drawing Sheets

SHAFT SEAL SYSTEM

BACKGROUND OF THE INVENTION

1. Field of the Invention

The present invention relates generally to an improved shaft seal system, and more particularly, to a dual seal system for a boat or other watercraft for creating a fluid tight seal between a rotatable shaft and a structure through which the shaft passes.

2. Description of the Related Art

Many designs for marine shaft seal systems have been designed in the past. None of them however, include a shaft seal system where a shaft seal may be replaced while the boat or watercraft is in a body of water, without removing it to dry dock.

Typical shaft seal systems only have one seal. Usually, water comes from the engine water pump to the shaft seal. The water circulates throughout channels or grooves in a bushing and exits through a tunnel of the boat to the body of water. With these types of shaft seal systems, water circulates to cool and lubricate the propeller shaft bushing. However, when the watercraft accelerates and attains a cruising speed, a vacuum is created in the tunnel. During high shaft rotation, the vacuum forces water to exit the bushing, not allowing the water to cool and lubricate when most needed.

If there is a seal failure, water immediately enters the boat. Additionally, when a shaft seal needs to be replaced with this type of shaft seal system, the watercraft needs to be removed from the body of water to a dry dock. This procedure is time consuming and expensive. The instant invention remedies this problem easily and efficiently.

Applicant believes that the closest reference corresponds to U.S. Pat. No. 6,039,320 issued to MacDonald for an "Adjustable Seal For Propeller Drive Shaft". However, it differs from the present invention because MacDonald teaches an adjustable sealing device for sealing between rotatable drive shaft, such as a propeller drive shaft, and the aperture in a structure, such as the hull or bulkhead of a vessel, through which the shaft passes. The device is generally rigid and is comprised of an adapter ring, a slide ring, a diaphragm positioned between the adapter ring and the slide ring, a friction ring having one end positioned in the adapter ring and a seal surface engageable with the seal surface of a seal ring rotatable with the shaft, biasing means positioned between the slide ring and the friction ring for urging the seal surfaces together, and a spring cover acting as a seal redundant to the diaphragm.

Other patents describing the closest subject matter provide for a number of more or less complicated features that fail to solve the problem in an efficient and economical way. None of these patents suggest the novel features of the present invention.

SUMMARY OF THE INVENTION

A shaft seal system for watercrafts. The invention comprises two seals, one at each end of a cylindrical member with cooling and lubrication means within a camera. To cool and lubricate, water enters an entry port and circulates throughout the camera channels and watercraft shaft, which drives the watercraft propeller. Said water then exits an exit port.

The water to cool and lubricate the seals and bushing comes from the engine water pump. An entry port hose connects the engine water pump to the entry port of the bearing. Water circulates to both seals throughout the camera channels, and exits through the exit port on the other side of the bearing. Water that exits through the exit port flows through an exit port hose to an exhaust system.

This instant invention proposes increased cooling and lubrication regardless of watercraft speed, resulting in longer lasting seals and reduction of maintenance.

More specifically, the instant invention is a shaft seal system rotably mounted on a propeller shaft for a watercraft hull comprising a cylindrical member with first and second ends, said cylindrical member housing a first shaft seal. The first shaft seal is retained within said cylindrical member adjacent to said first end and the second end has a peripheral flange. A removable ring comprises a plurality of semi-rings cooperatively fastened to each other to house a second shaft seal within. The removable ring has cooperative dimensions to fastenly secure to the peripheral flange of the cylindrical member. The said second shaft seal may be replaced with a new shaft seal rotably mounted on said propeller shaft while the watercraft is in a body of water without the intrusion of water inside a hull.

Additionally, the shaft seal system further comprises means for cooling and lubricating said shaft seal system and said propeller shaft. The cooling and lubricating means comprise a bearing with third and fourth ends, housed within said cylindrical member at a first predetermined distance from said first end, extending a second predetermined distance towards said second end without reaching said second end. The bearing comprises a plurality of channels to allow water to circulate between said first and second shaft seals and around said propeller shaft. The bearing has an entry port to allow said water to flow in and an exit port to allow said water to flow out of said bearing. The water to cool and lubricate flows to said entry port from a water pump and to an exhaust system from said exit port.

To prevent water leakage between the cylindrical member and the removable ring, a seal such as an "O" ring, fits between said removable ring and said flange.

To secure the cylindrical member to a tunnel of a hull, or an extension from the hull, the cylindrical member is threaded a third predetermined distance from said first end towards said second end without reaching said second end, wherein a hose from said watercraft is clamped to said cylindrical member where threaded to secure said shaft seal system on said propeller shaft.

The second shaft seal may be replaced with a nylon flex, rubber, cloth, or similar pack when a new shaft seal is not available on the propeller shaft.

It is therefore one of the main objects of the present invention to provide a shaft seal system utilized on watercrafts, having dual seals, of which one of the seals may be replaced while the watercraft is in a body of water.

It is another object of the present invention to provide a shaft seal system having dual seals, of which one of the seals may be replaced without having to remove the watercraft to dry dock.

It is another object of the present invention to prevent water from entering a vessel and leaving the confines of the shaft seal system according to the invention.

It is another object of the present invention to provide a shaft seal system utilized on vessels having a propeller shaft extending from an inboard motor or gear box to an outboard propeller.

Another object of the invention is to provide means incorporated within, for cooling and lubricating, where water enters an entry port and circulates throughout camera channels within a cylindrical member and around a shaft which drives the watercraft propeller.

Another object of the invention is to provide a system for preventing water from entering a vessel having a shaft, which extends through the hull or bulkhead of the vessel.

A further object of the invention is to provide a fluid-sealing device for a vessel having a shaft, which runs through the hull or bulkhead of the vessel, which can be used with many different types of apparatus for receiving a shaft where it extends through the hull or bulkhead.

Another object of the present invention is to provide a device as described above to which adapters may be attached, each respective adapter adapting the device for mounting to a different hull aperture configuration.

Another object of the present invention is to provide a device as described above which includes a dual seal system.

Another object of the invention is to provide a water-seal apparatus for the shaft of a vessel which is safe in operation, durable and easy to make, uses known components and raw materials, and which furthermore is effective, efficient and reliable in operation.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3*a* represents a cut view of a bushing.

DETAILED DESCRIPTION OF THE PREFERRED EMBODIMENT

Figure 1:
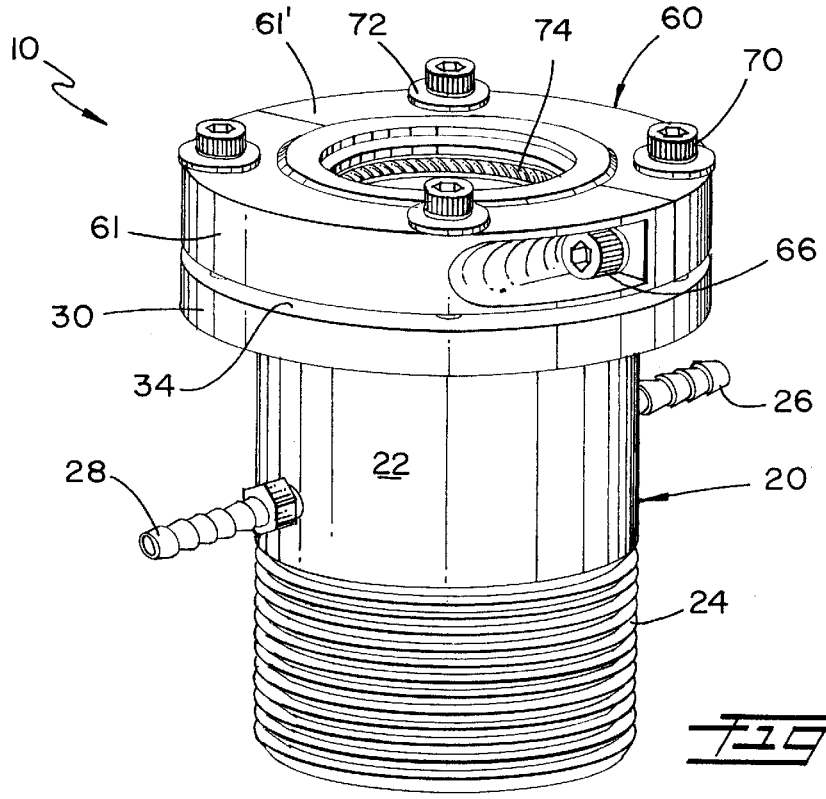
FIG. 1 represents a perspective view of the instant invention.

Referring now to the drawings, where the present invention is generally referred to with numeral 10, it can be observed that it basically includes bearing 20 and removable ring 60.

As seen in FIG. 1, removable ring 60 is mounted onto bearing 20. In the preferred embodiment, removable ring 60 comprises semi-rings 61 and 61', which are fastened together with bolts 66. Semi-rings 61 and 61', form a circle in the preferred embodiment, and are fastened against face 34 of flange 30. Bolts 70 and washers 72 may be utilized to securely fasten removable ring 60 to bearing 20. Removable ring 60 keeps seal member 74 secure and stationary. Extending perpendicularly from flange 30 is cylindrical member 22. Cylindrical member 22 has entry port 26 at one side and exit port 28 approximately 180 degrees away. Opposite from removable ring 60, cylindrical member 22 has threads 24 for gripping purposes.

Bearing 20 and removable ring 60 are made of a corrosion resistant durable material such as brass, metallic alloy, plastic composition, or other with similar properties.

Figure 2:
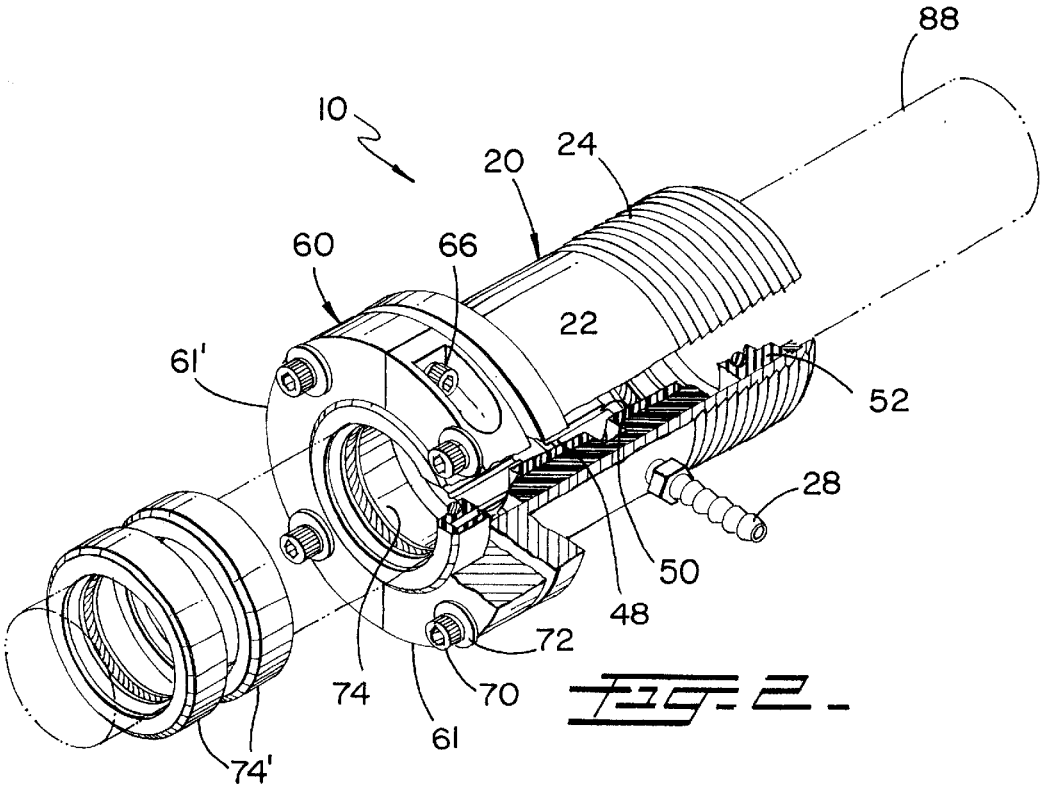
FIG. 2 shows a cut view of the instant invention on a shaft.

As seen in FIG. 2, instant invention 10 is rotably mounted on shaft 88. Removable ring 60 has bolts 66, which secure semi-ring 61 to semi-ring 61'. In the preferred embodiment, semi-ring 61 and 61' each have at least two bolts 70 to secure them to bearing 20. Seal member 74 is secured and kept in place with removable ring 60. Additional seal members 74' are installed on shaft 88 to replace a deteriorated or failed seal member 74 after extensive use.

Removable ring 60 keeps seal member 74 secure and in place. Seal member 74 prevents water from entering watercraft 80, and more specifically, the engine compartment where engine 82 operates in, seen in FIG. 4.

Figures 2, 3:
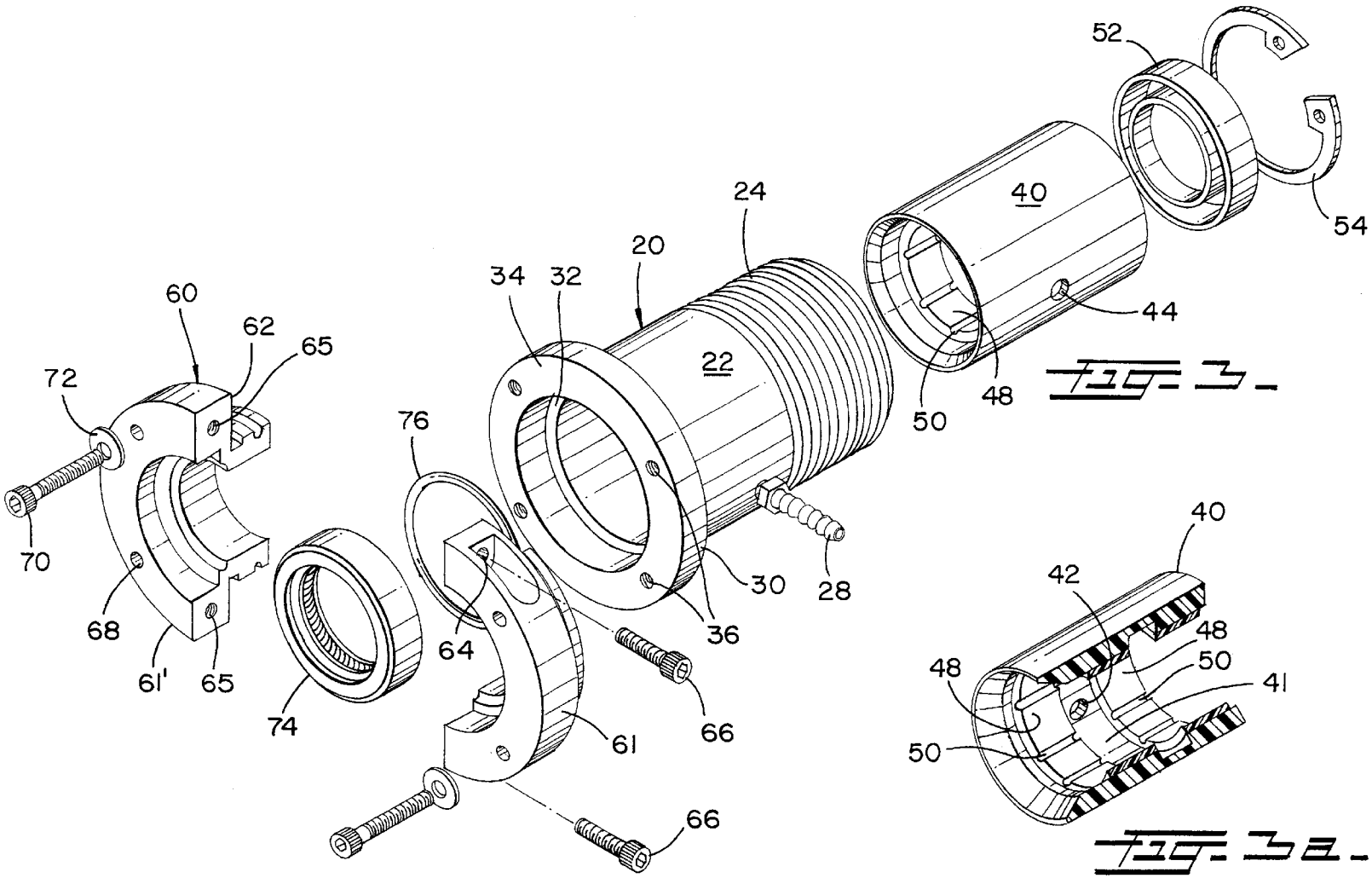
FIG. 3 represents an exploded view of the instant invention.

As seen in FIG. 3, bolts 66 trespass holes 64 of semi-ring 61 to secure to apertures 65 of semi-ring 61'. Before tightening bolts 66, seal member 74 is placed to snugly fit within removable ring 60. O ring 76, to prevent water seepage between removable ring 60 and bearing 20 fits against face 32 of flange 30. Removable ring 60 has face 62 that meets face 34 of flange 30. Once pressed against face 34, bolts 70 through washers 72 trespass holes 68 to fasten to apertures 36 of flange 30.

Cylindrical member 22 extends perpendicularly from flange 30 as a solid piece. Cylindrical member 22 has exit port 28 extending therefrom and has an end section with threads 24. Cylindrical member 22 houses bushing 40 within. Bushing 40 has a through cavity within, camera 48. Bushing 40 also has hole 44, which is cooperatively aligned and of dimensions with exit port 28. Snap ring 54 fits at an end section of cylindrical member 22 and contains seal member 52 against bushing 40.

Seal member 52 prevents external water, such as ocean, lake, or river water from entering camera 48 of cylindrical member 22. If there is any failure of seal member 52, water from the body of water will enter camera 48, flow through exit port 28 and out through exhaust system 84, seen in FIG. 4.

Seen in FIG. 3*a* is a cut view of a section of bushing 40. Hole 42 is cooperatively aligned and of dimensions with entry port 26, seen in FIG. 1. Water that enters camera 48 initially flows throughout channel 41. The water within then flows throughout camera 48, around shaft 88, seen in FIG. 2, and throughout camera channels 50. The circulation of water within camera 48 cools and lubricates all the components of the instant invention as well as shaft 88. After circulating throughout camera 48, water exits through exit port 28, seen in FIG. 3.

Figure 4:
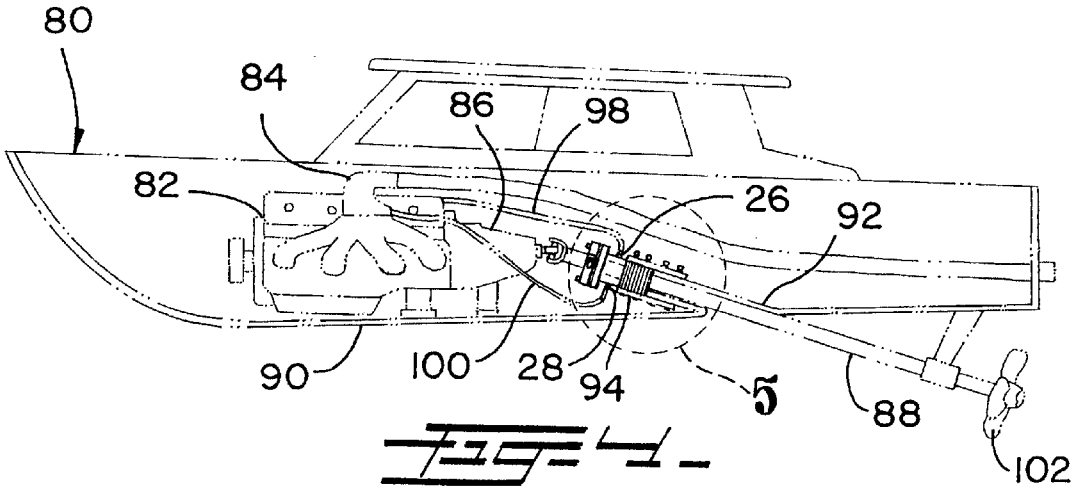
FIG. 4 shows the instant invention mounted in a water vessel.

As seen in FIG. 4, watercraft 80 has bottom 90 of a hull and tunnel 92 extending from bottom 90 into the watercraft hull. Within watercraft 80 is engine 82. Extending from engine 82 is exhaust system 84. Transmission 86 connects engine 82 to drive shaft 88, which rotates propeller 102. Secured to engine 82 is a water pump, not seen. Extending from the water pump of watercraft 80 is entry port hose 98, which connects to entry port 26. Exit port hose 100 connects exit port 28 to exhaust system 84. To cool and lubricate the present invention, water flows from the water pump through entry port hose 98 and into instant invention 10. The water then exits through exit port hose 100 to exhaust system 84.

Figure 5:
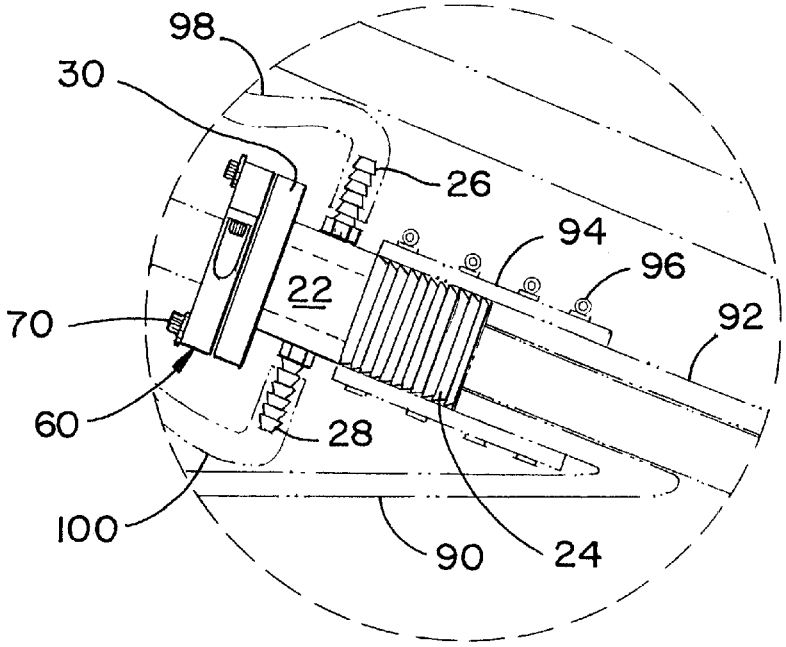
FIG. 5 shows a blow up view of the instant invention mounted onto the tunnel of a water vessel.

As seen in FIG. 5, the present invention is mounted onto tunnel 92, which extends from bottom 90 of watercraft 80. Hose 94 extends from tunnel 92 over threads 24 of cylindrical member 22. Threads 24 provide gripping for hose 94 to secure upon. Clamps 96 may be utilized to secure the instant invention onto tunnel 92 and provide a water tight seal.

REPLACING SEAL MEMBER 74

If seal member 74 deteriorates and needs to be replaced or if it fails, water flow from the engine pump, not seen, must be shut off. Once off, seal member 74 may be replaced. The user disconnects exit port hose 100 to determine if seal member 52 is in satisfactory condition. If seal member 52 is properly preventing water from entering camera 48, removable ring 60 is removed. The user slides down a replacement seal member 74' already upon shaft 88 and removable ring 60 is re-secured. If seal member 52 is not in good condition but only a small amount of water enters through, the replacement of seal member 74 may still take place, even with watercraft 80 in the body of water.

Alternatively, if there is not an extra seal member 74' available on shaft 88, a nylon flex packing or a similar pack may be used instead of seal member 74'.

The water flow to cool and lubricate bushing 40 may be controlled if necessary by a valve from the water pump, not seen, in order to obtain the best results.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shaft seal system rotably mounted on a propeller shaft for a watercraft hull comprising:

A) a cylindrical member with first and second ends, said cylindrical member housing a first shaft seal, said first shaft seal retained within said cylindrical member adjacent to said first end, said second end having a peripheral flange; and B) a removable ring comprising a plurality of semi-rings cooperatively fastened to each other to house a second shaft seal within, said removable ring having cooperative dimensions to fastenly secure to said peripheral flange, wherein said second shaft seal may be replaced with a new shaft seal rotably mounted on said propeller shaft while said watercraft is in a body of water without the intrusion of water inside a hull.

2. The shaft seal system set forth in claim 1, wherein said shaft seal system further comprises means for cooling and lubricating said shaft seal system and said propeller shaft.

3. The shaft seal system set forth in claim 2, wherein said cooling and lubricating means comprise a bearing with third and fourth ends, housed within said cylindrical member at a first predetermined distance from said first end, extending a second predetermined distance towards said second end without reaching said second end, said bearing comprising a plurality of channels to allow water to circulate between said first and second shaft seals and around said propeller shaft, said bearing having an entry port to allow said water to flow in and an exit port to allow said water to flow out of said bearing.

4. The shaft seal system set forth in claim 3, wherein said water flows to said entry port from a water pump and to an exhaust system from said exit port.

5. The shaft seal system set forth in claim 4, wherein a seal fits between said removable ring and said flange.

6. The shaft seal system set forth in claim 5, wherein said cylindrical member is threaded a third predetermined distance from said first end towards said second end without reaching said second end.

7. The shaft seal system set forth in claim 6, wherein a hose from said watercraft is clamped to said cylindrical member where threaded to secure said shaft seal system on said propeller shaft.

8. The shaft seal system set forth in claim 7, wherein said second shaft seal may be replaced with a nylon flex pack when said new shaft seal is not available.

9. The shaft seal system set forth in claim 7, wherein said second shaft seal may be replaced with a rubber pack when said new shaft seal is not available.

* * * * *